United States Patent [19]

Loane

[11] Patent Number: 4,743,014

[45] Date of Patent: May 10, 1988

[54] SKI EXERCISING APPARATUS

[76] Inventor: R. Joel Loane, 535 Placitas Ave., Atherton, Calif. 94025

[21] Appl. No.: 80,755

[22] Filed: Jul. 30, 1987

[51] Int. Cl.[4] ..... A63B 69/18

[52] U.S. Cl. ..... 272/97; 272/142

[58] Field of Search ..... 272/97, 69, 70, 72, 272/93, 96, 142, 146, 127, 135, 136, 138, DIG. 4; 128/25 R, 25 B

[56] References Cited

U.S. PATENT DOCUMENTS

| | | | |
|---|---|---|---|
| 3,524,641 | 8/1970 | Ossenkop | 272/142 |
| 3,547,434 | 12/1970 | Ossenkop | 272/97 |
| 3,620,530 | 11/1971 | Cosby | 272/142 |
| 4,669,723 | 6/1987 | Arsenian | 272/97 |

*Primary Examiner*—Richard J. Apley
*Assistant Examiner*—S. R. Crow
*Attorney, Agent, or Firm*—Joseph H. Smith

[57] ABSTRACT

A device for exercising is provided having a pair of rails that are held in a spaced apart parallel relationship by a brace element. A platform is provided for riding on the rails and a first resilient element provides a first restoring force on the platform which is directed toward the middle of the rails. A second resilient means provides a second restoring force on the platform which is directed toward the middle of the rails. An adjustment element is then used to adjust the magnitude of the second restoring force, the adjustment element contacting the second resilient element at at least three points, with a first one of the three points located in a vertical plane on one side of the middle of the rails, with a second one of the three points located in a vertical plane on the other side of the middle of the rails, and with a third one of the three points associated with the platform and moving therewith.

13 Claims, 11 Drawing Sheets

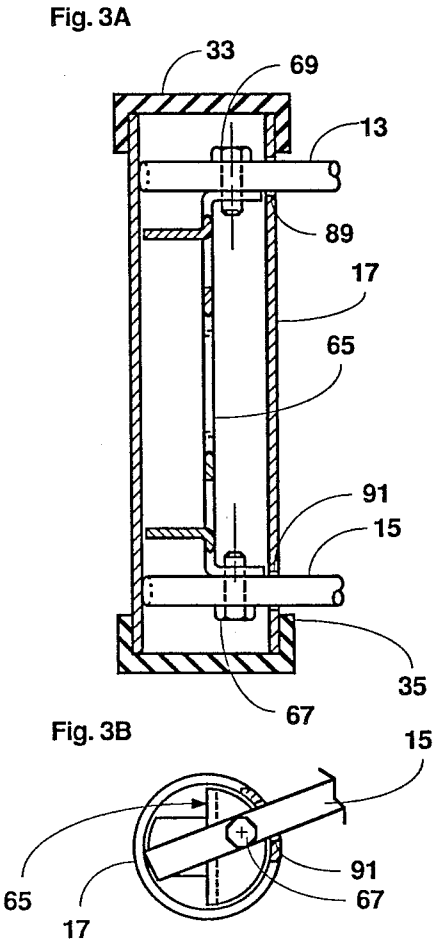
Fig. 3A
Fig. 3B
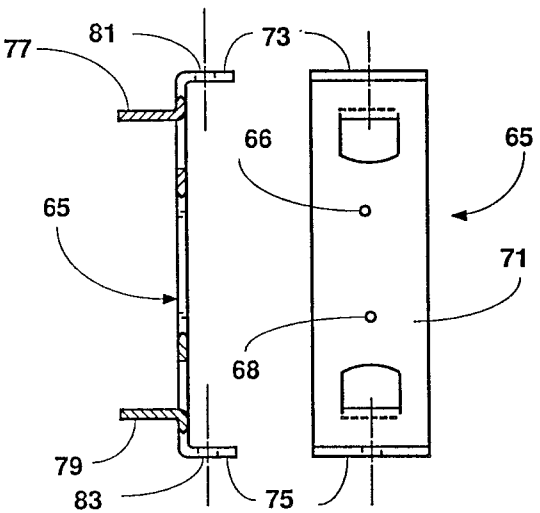
Fig. 2B
Fig. 2A
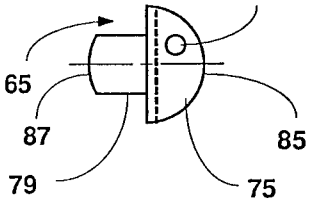
Fig. 2C

SKI EXERCISING APPARATUS

FIELD OF THE INVENTION

This invention relates to exercising apparatus for allowing a user to simulate the motions, exertions and techniques involved in skiing, thereby increasing the user's strength and skill, and more particularly to improvements in such apparatus.

BACKGROUND OF THE INVENTION

Apparatus for use by skiers on which they may simulate the motions, exertions and techniques required in skiing has been built and sold for several years. In particular U.S. Pat. No. 3,524,641 was issued to Robert J. Ossenkop on Aug. 18, 1970, for a device comprising a movable carriage on a set of rails. The carriage of that device is constrained in its movement on the rails by flexible members attached to both the carriage and to transverse members between the rails near each end of the set of rails, and a user can move the carriage from side to side on the rails to simulate the parallel or "parallel" technique of skiing.

U.S. Pat. No. 3,547,434 was issued to the same inventor on Dec. 15, 1970. This later referenced patent is for a device similar to the first device, but comprising a number of improvements, such as moveable footrests on the carriage whereby a user may simulate turning and edging techniques in addition to parallel skiing; and, in some embodiments may also move the feet relative to one another.

The inventions referenced above each comprise a safety strap attached to a transverse member between the parallel rails and to the carriage on the rails in addition to the flexible member by which the carriage is constrained to travel on the rails. Without the safety strap a clear danger exists by virtue of the fact that the aforementioned flexible member is firmly attached to each end of the apparatus and also to the center underside of the wheeled carriage. If, during operation, the flexible member should rupture on either side, the carriage would suddenly and forcibly snap to the opposite end, and a user would almost certainly be ejected and perhaps seriously injured.

The aforementioned safety strap in the referenced inventions is fastened to a U-shaped transverse member near the center of the arched rail set and by the other end to the underside of the carriage. The length of the safety strap is such that with the carriage at its neutral position near the center of the rails the strap is loose, and has considerable slack length. The carriage may thus move a relatively long distance toward one end or the other of the rail set under only the constraint of the main flexible strap before the safety strap is straightened and will begin to extend. This distance (to either side) is approximately one half of the distance from the neutral carriage position at the center of the rail set to either end of the rail set. If the obvious accident should happen, the flexible member rupturing on one side or the other, the carriage would suddenly be propelled to the opposite side until the point at which the slack in the safety strap is "taken up", at which point the safety strap would begin to provide an increasing force in the direction opposite to the travel direction of the carriage. The safety strap is a flexible member like the main flexible member so that it can do this. This action is certainly an improvement over what would be expected if there were no safety strap, but, owing to the original slack, there would be still a period of acceleration, followed by a sudden decelleration, and certainly oscillation about the point at which the forces provided by the main flexible strap and the safety strap would balance. A user, surprised by the sudden rupture and acceleration, might still be thrown off, and perhaps injured.

One solution would be to make the safety strap shorter so that it would immediately stretch as the carriage moves to either side, but this solution has a serious drawback; the height of the carriage on the rails is short compared to the length of the rail track to either side. Being "short coupled", the safety strap would have too far to stretch, and would provide far too much force to the carriage in regular operation; and would also, by virtue of the very long stretching compared to its original length, be subject to fatigue beyong what would be prudent in design. To avoid fatigue effects, a flexible member such as the rubber straps used in this invention, should not be regularly stretched more than about 75% of its original length.

Also in regard to the arrangement of the safety strap, the U-shaped transverse member of the two referenced inventions is a single rail fastened with a single screw fastener at each end to the track rails, and the aforementioned safety strap is fastened to the bottom (central) leg of this member, near the floor. If the previously discussed accident should occur, at the point that the slack in the safety strap is all taken up, a twisting moment would be applied about an axis of rotation passing through the two screw fasteners where the transverse member is fastened to the rail set, with a magnitude equal to the force applied by the safety strap and the length of a side leg (vertical leg) of the transverse member to which the safety strap is fastened. As the carriage would continue to move under the continuing inertia of the user, this movement would increase sharply in amplitude. Under these conditions, in the apparatus shown in the two referenced inventions in the prior art, it is highly likely that there would be a sudden collapse of the transverse member in the direction of the carriage movement, adding a further sudden imbalanced movement tending to dislodge the user.

The apparatus of the prior art, while not providing adequately for the user's safety, also provides only a minimum amount of adjustability for the user to compensate for the user's weight (or mass), and to provide for changes in force against the carriage to simulate varying skiing conditions. In the referenced inventions of the prior art the only way to make such adjustments is to loosen the flexible straps at the ends of the rails away from the carriage and pre-stretch the strap, using the buckle that holds the strap around the end transverse member. Both straps have to be stretched an equal amount to accomplish such an adjustment, and there is no clear way to tell when equal adjustment has been accomplished; only the neutral position of the carriage. Furthermore, each time the bucle at one end or the other is loosened, there is an opportunity to make a mistake in the rethreading and securing of the buckle, posing an additional safety hazard for the user.

Accordingly, what is needed is a ski exercising apparatus that is safer for the user, and that has a broader range of adjustments than the exercisers of the prior art. Further, it would be desireable to have an exerciser in which the broader range of adjustments may be made conveniently and without danger of weakening the apparatus or providing other hazards, for example, leaving a main flexible member or safety strap undone or improperly assembled. Also, it would be desireable to have an apparatus that is more stable in operation and more durable than exercisers of the prior art, without adding appreciably to the cost of manufacture, and which is relatively easy to assemble, and may be packaged in a minimum volume for storage and shipment.

SUMMARY OF THE INVENTION

In accordance with preferred embodiments of the invention, a device for exercising is provided having a pair of rails that are held in a spaced apart parallel relationship by a brace element. A platform is provided for riding on the rails and a first resilient element provides a first restoring force on the platform which is directed toward the middle of the rails. A second resilient element provides a second restoring force on the platform which is directed toward the middle of the rails. An adjustment element is then used to adjust the magnitude of the second restoring force, the adjustment element contacting the second resilient element at at least three points, with a first one of the three points located in a vertical plane on one side of the middle of the rails, with a second one of the three points located in a vertical plane on the other side of the middle of the rails, and with a third one of the three points associated with the platform and moving therewith. In the particular embodiments disclosed, the adjustment of the second restoring force is affected by a movement element which moves the first and second points in a horizontal direction, thereby changing the magnitude of the second restoring force caused by the second resilient element. In the preferred mode, the rails are arcuate, so that the user, by moving his body in the motions normally associated with parallel skiing, may cause the platform to swing back and forth.

The exerciser of the preferred embodiment further includes a unique central brace supporting an assembly of easily moveable rollers, which together with the second resilient element are parts of the adjustment device providing a means of adjusting the forces operable on the platform over a wide variety of conditions. Adjustments may be made without ever disconnecting a main anchor point for any resilient element. The central brace that holds the adjustment assembly serves also as a broad and rugged additional support in use. The incorporation of two resilient elements, separately anchored to the frame, provides redundancy in the event of failure of one or the other of the resilient elements. Additional improvements render the exerciser of the invention quieter, easier to operate, more convenient to assemble, more attractive and easier to package and ship than previous exercisers.

BRIEF DESCRIPTION OF THE DRAWINGS

FIG. 2A is a plan view of a rail end bracket used in fastening the rails to an end member.

FIG. 2B is a rotated view of the bracket of FIG. 2A.

FIG. 2C is an end view of the bracket of FIG. 2A.

FIG. 3A is a plan view in partial section showing how the bracket of FIG. 2A is used to fasten the rails together.

FIG. 3B is an end view in partial section of the assembly of FIG. 3A.

DESCRIPTION OF THE PREFERRED EMBODIMENTS

The General Assembly

Figure 1A:
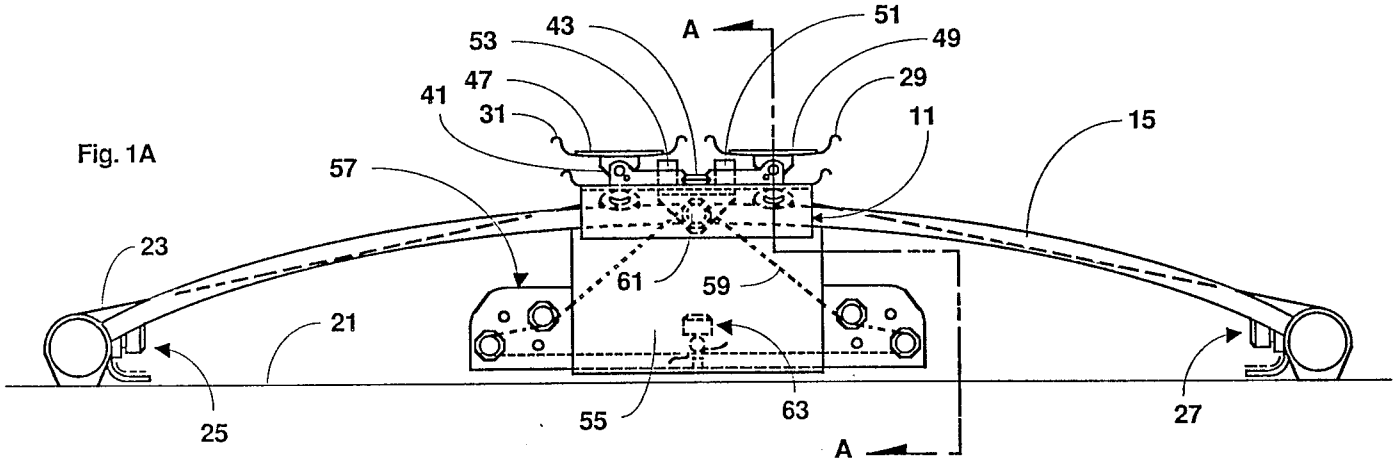
FIG. 1A is an elevation view of an exerciser according to the preferred embodiment.
Figure 1B:
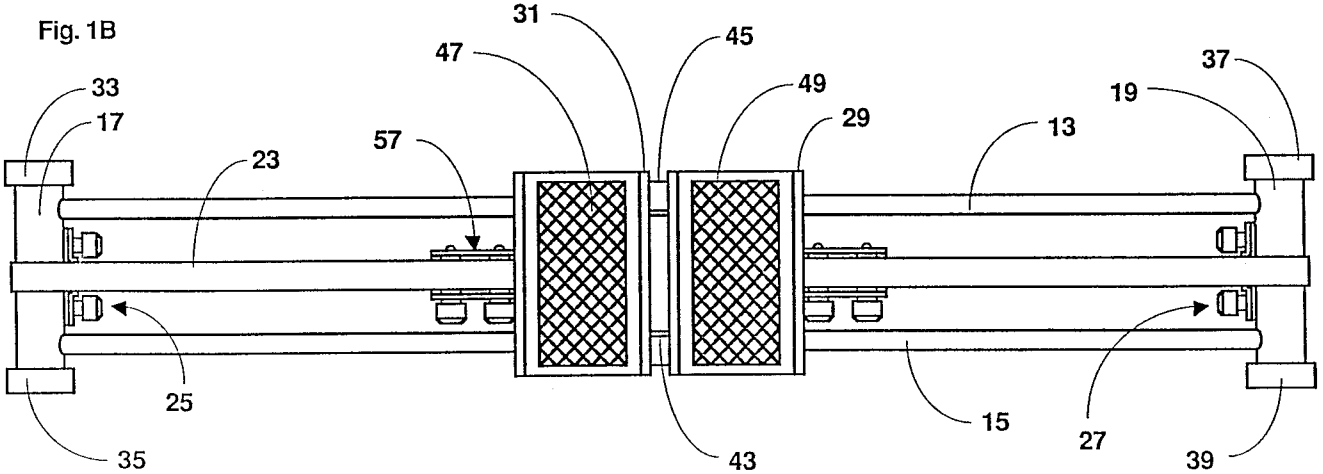
FIG. 1B is a plan view of the exerciser of FIG. 1A.

FIG. 1A is an elevation view of an exerciser according to the preferred embodiment of the invention. FIG. 1B is a plan view of the exerciser of FIG. 1A. A wheeled carriage 11 rides on a pair of arcuate rails 13 and 15, which are fastened together and held parallel by transverse end members 17 and 19. In the preferred embodiment, the rails are about 2.5 cm. diameter in cross section, and the center-to-center spacing between the rails is about 23 cm. The rails are preferrably steel tubing with a wall thickness of 13 gauge, and buffed and chrome plated, which provides exceptional wear and pleasing appearance, although in other embodiments other materials and treatments may be used, as long as the strength of the members is sufficient to stand the expcepted loading with an adequate safety margin. End members 17 and 19 are also steel tubing, similarly finished as the rails. The diameter of the end members is about 6 cm. The overall width of the assembly is about 38 cm., the overall length in the direction of the arc about 1.6 meters, and the height from floor line 21 to the top of the rails at the highest (center) point is about 15 cm.

A flexible strap 23 is fastened at one end to end member 17 by clamp assembly 25, at a central point to carriage 11 by a clamp assembly (shown in FIG. 7B), and at the other end to end member 19 by another clamp assembly 27 similar to clamp assembly 25. The flexible strap is natural gum rubber in the preferred embodiment, but may be other flexible materials in other embodiments, such as synthetic rubber. At each end of each of the end members there is a cap, also of rubber in the preferred embodiment, to form the contact of the overall assembly to the floor and to provide a non-skid characteristic on the floor. Caps 33 and 35 are at the ends of end member 17 and caps 37 and 39 are at the ends of end member 19.

Carriage 11 has ball bearing wheels by which it rides on the rail set, which are shown in subsequent drawings, and two foot platforms 29 and 31. The foot platforms are pivoted on flanges of a pivot platform 41, which is fixedly attached to carriage 11, and the foot platforms are connected by links 43 and 45 such that the foot platforms may rock back and forth in the direction of the carriage travel, but are constrained to rock together, and forced to assume a common attitude of tilt. Link 43 is seen by broken section in FIG. 1A. Link 45 is in FIG. 6B. Each foot platform has a non-skid pad added to the upper surface, pad 47 on platform 31 and pad 49 on platform 29. The amount that the foot platforms may tilt to one side and the force required to accomplish the tilt is limited by a stack of resilient strips 51 to one side and by a similar stack of resilient strips 53 to the other side. In the preferred embodiment, the resilient strip are foam rubber, but may be other flexible material in other embodiments.

There is a U-shaped support member 55 attached to the rails near the center between the end pieces 17 and 19. This member has a dual purpose. One purpose is to provide additional strength for the rail assembly. Two vertical portions 56 and 58 of support member 55 fit into and fasten to the rails, one portion to rail 13 and the other to rail 15. The strength of the vertical legs of member 55, which in the preferred embodiment is steel, about 0.3 cm. in wall thickness, helps to hold the spacing between side rails 13 and 15. In addition, the bottom of member 55 when the apparatus is not in use is about 0.6 cm. above the floor line, so that when the apparatus is in use, flexure of the rails will result in the bottom of member 55 contacting the floor and providing sturdy support for the assembly. Member 55 is, like the rails, end pieces, and other highly visible pieces of the apparatus, buffed and chrome plated for appearance sake; although that particular treatment may be different in other embodiments.

Another purpose of the support member is as a frame support for an adjustment assembly 57 which, along with a flexible strap 59 and a roller assembly 61 attached to carriage 11, forms an arrangement of elements whereby tension may be adjusted and broadly varied on the carriage without disturbing either clamps 25 and 27 that anchor strap 23, or a clamp assembly 63 which anchors strap 59. This adjustment is done by simply moving pivot rollers from one set of holes to another, as will be subsequently shown in greater detail.

Track End Assembly

In the preferred embodiment, rails 13 and 15 are spaced apart and fastened together at each end of the exerciser. It is desirable that the way in which the fastening is done should allow rails 13 and 15 and end members 17 and 19 to be separable so the package in which the parts of an exerciser is shipped and stored may be conveniently small. Accordingly, a unique rail end bracket 65, shown in detail in FIGS. 2A, B and C, is used within each end member to hold the rails in the proper orientation and at the proper spacing.

Bracket 65, in the preferred embodiment, is formed from a single shaped strip of steel plate, approximately 0.3 cm. thick, and does not require special finishing for appearance. In the preferred embodiment the bracket is given a treatment for corrosion resistance, such as a chromate coating, but it may also be formed from a non-corroding material. The bracket has a central portion 71 that is in the plane of the original material from which the bracket is formed. The ends of the original material are bent at 90 degrees to portion 71, forming two flanges 73 and 75, which are shaped to the approximate curvature of the inside diameter of a tubular end member. There are two additional flanges 77 and 79 that are formed by punching openings in portion 71 and bending the punched portions at 90 degrees to portion 71, but in the opposite direction to the end flanges.

End flange 73 has a punched hole 81 of about 0.6 cm. diameter, and end flange 75 has a similar hole 83. The formation of the bracket is such that curved outer edge 85 of flange 75 is a circular arc and curved outer edge 87 of flange 79 is also a circular arc of the same radius. End flange 73 and inner flange 77 are formed in a similar manner. The radius of curvature for these edges is a small amount less than the radius of the inside of an end member of the apparatus, so that the bracket may be inserted freely into an end member in the process of assembly, but leaving very little margin for diametral movement. There are also two holes, 66 and 68, of about 0.6 cm. diameter, in central portion 71, and these are for bolts to clamp strap 23, as will subsequently be shown.

FIG. 3A and FIG. 3B show how bracket 65 is used within an end member to fasten rails together. FIG. 3A is a plan view, cut away to show the inside of end member 17, and bracket 65 is shown positioned within the tubular end member about midway between the ends. There is a hole 89 in end member 17 for rail 13 to pass through to the inside, and a similar hole 91 for rail 15 to pass through. The spacing between the holes is the desired spacing between the rails, and with the rails in the holes, each rail is adjacent to an end flange of bracket 65. A self-tapping screw 69 passes through a hole near the end of the rail 13 and into hole 81, where it forms its own threads and firmly attaches the rail to the bracket within end member 17. Rail 15 is similarly inserted and fastened by self tapping screw 67. Both rails butt against the inside diameter of member 17, adding additional stability to the assembly. Once the screws are secure, end caps 33 and 35 may be installed at the ends of the end member leaving the fastening arrangement hidden from view, and allowing still that the several parts may be stored and shipped disassembled to save space and cost. Rails 13 and 15 are joined at the opposite end of the exerciser with another bracket in a manner similar to that described at end member 17.

The bracket of the preferred embodiment for joining and spacing the rails for the exerciser is but one of a number of ways that the joining and spacing may be accomplished. It will be apparent to a worker skilled in the art that other ways are available to accomplish the object. Rails 13 and 15 may be welded to end members 15 and 17 for instance, but there are problems with the welded structure, such as difficulty in achieving a uniform chrome plating for a proper appearance, and the size of the package required for storage and shipping, that are solved by the technique of the preferred embodiment.

THE WHEELED CARRIAGE

Figure 4:
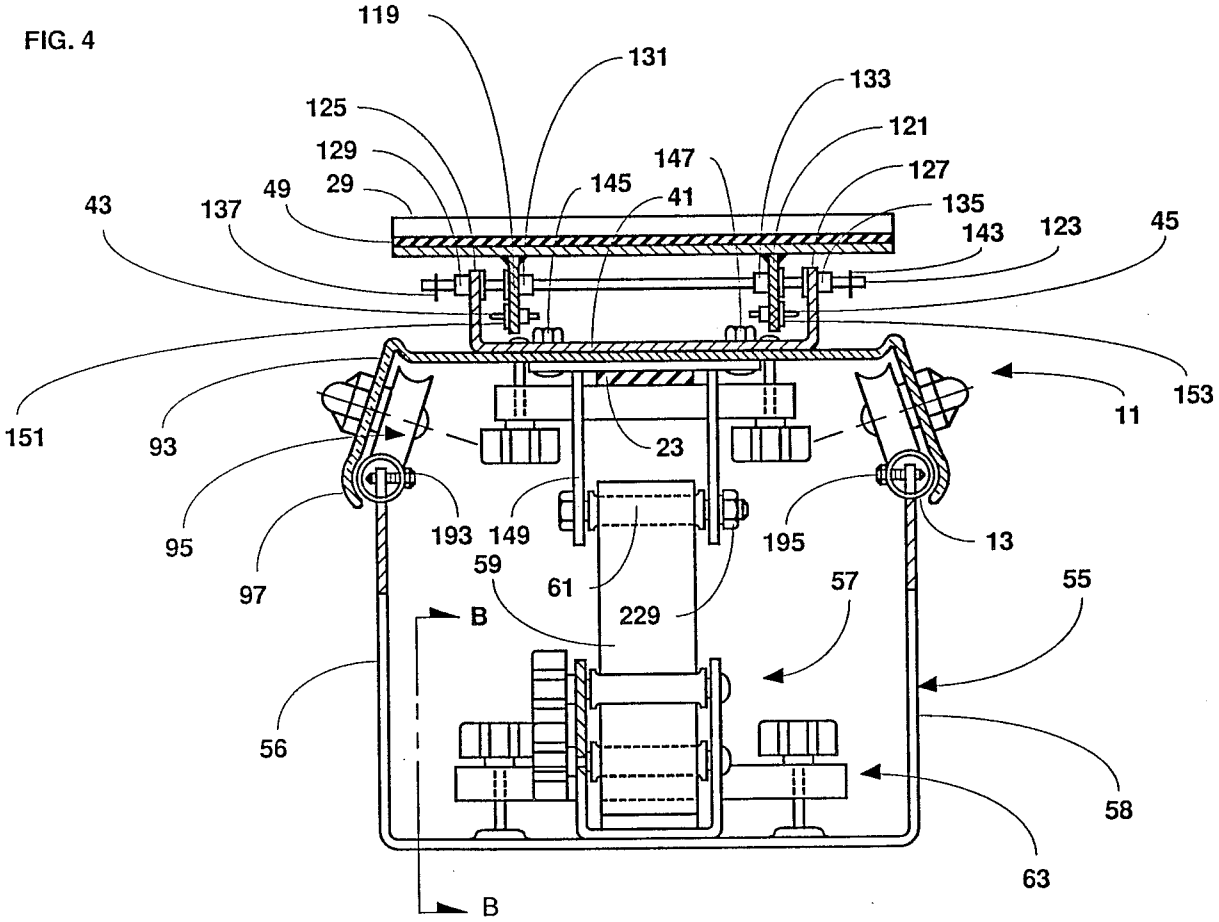
FIG. 4 is an end elevation section taken along the line A—A of FIG. 1A.

FIG. 4 is a section view taken along line A—A of FIG. 1A in the direction of the arrows. The section is through wheeled carriage 11 at the mounting point for two of four wheels upon which the carriage rides on arcuate rails 13 and 15. The carriage has a main body 93 which is a sheet metal stamping, and the stamping has four punched holes for mounting wheel assemblies such as assembly 95. Body 93 in the preferred embodiment is buffed and chrome plated for appearance sake, but other treatments might be suitable in other embodiments. The sides of body 93 are angled at approximately 20 degrees away from the axis of symmetry so that the force of the weight of a user of the apparatus, who would be standing on the foot platforms, will be directed slightly outward to each side, thereby increasing the stability of the assembly. The wheel assemblies mount through these angled portions. There is a skirt extension 97 below the point where the wheel assemblies mount that follows the shape of one of the rails. This extension is repeated on the opposite side of the carriage, and serves to guard the area of rolling contact between the wheels and the rails, and to aid in keeping the carriage on the rails in the event of accident or enthusiastic use. The skirts are thus a safety feature.

Figure 5:
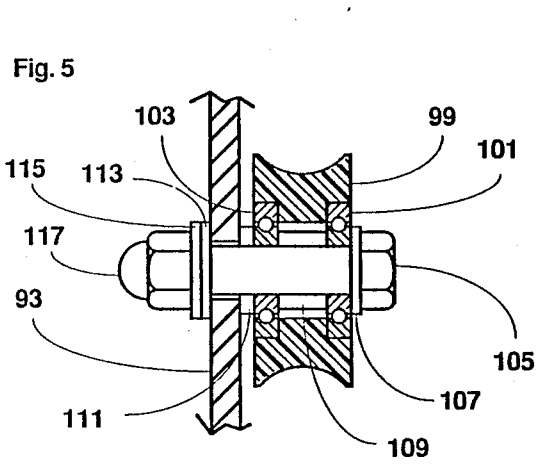
FIG. 5 is a section through a wheel of a wheeled carriage of the preferred embodiment.

Each of the four wheel assemblies in the preferred embodiment, of which assembly 95 is representative, is an assembly comprising precision bearings and a wheel, and is a distinct improvement over the prior art. FIG. 5 is a cross-section of wheel assembly 95. Wheel 99 is machined from a synthetic material formed of extremely long-chain polymers, called UHMW (for ultra high molecular weight). The width of the wheel is about 2 cm., which is about 80% of the diameter of one of the rails. This is considerably wider than wheels of devices in the prior art, and the increased area of contact of a wheel with a rail, wrapping as it does further around a rail, provides a more stable and quieter operation than was before possible. In particular, a larger force in the direction orthogonal to the direction of carriage movement is needed to dislodge the carriage from the rails.

Wheel 99 has machined internal shoulders into which precision ball bearings 101 and 103 are mounted. The bearings are of a higher quality than have heretofore been used with exercisers of this type, and are of a kind commercially available and used with skates and skateboards. A hex head bolt 105 is the shaft of the wheel and mounts with a flat washer 107 from one side. A cylindrical spacer 109 spaces the bearings inside the wheel on the inner races of the bearings and a second spacer 111 stands the wheel and bearing assembly away from body 93 of the carriage. A chromed flat washer 113, a lock washer 115 and a chrome-plated castle nut 117 fasten the assembly to the carriage body on the side opposite the wheel. In other embodiments it may not be required that the fasteners be chrome plated, as this treatment is for appearance sake, and it will be apparent to those skilled in the art that there are other arrangements for fastening the wheel assemblies to the carriage.

It has been found in extensive trials that the improved assembly illustrated provides a safer, smoother, quieter operation, and is more durable than exercisers of the prior art.

In the exerciser according to the preferred embodiment, a pivot platform 41 is fastened atop carriage body 93 of carriage 11, and the pivot platform is for the mounting of two foot platforms for the user's feet. With a non-skid material similar to the material of foot pads 47 and 49 added to the top surface of carriage 11, without platform 41 or the associated foot platforms, the exerciser may be used to simulate parallel type skiing without edging technique, and this use is an alternative embodiment of the invention.

Foot Platforms

In the preferred embodiment two individual foot platforms, platform 29 and platform 31, are mounted pivotally to the carriage assembly so that a user may simulate edging technique while using the apparatus. The two platforms are shown mounted side by side to flanges of pivot platform 41 in FIG. 1A, and the cross-section view of FIG. 4 shows a section through pivot platform 41 and foot platform 29. Platform 29 is of sheet metal construction and has non-skid pad 49 affixed to its upper surface. The pad material is synthetic rubber with tread impressions similar to and for the same purpose as a tire for a vehicle. The pad is fixed to the foot platform by an adhesive in the preferred embodiment. There are other kinds of materials that may be used to accomplish the object and other ways to fix the material to the surface in alternative embodiments, such as with screw fasteners.

Foot platform 29 has two depending ears 119 and 121, and each ear has a hole through which a hinge rod 123 passes. Pivot platform 41 has two upward extending flanges 125 and 127, and the flanges also have each a hole through which pivot rod 123 passes. The assembly of the foot platform to the pivot platform is by means of the hinge rod 123 and flanged bronze bushings 129, 131, 133 and 135. The spacing of ears 119 and 121 relative to the spacing of flanges 125 and 127 is such that ear 121 is spaced apart from flange 127 and ear 119 is spaced apart from flange 125 in assembly by a distance of about 1.3 cm. Hinge rod 123 is held in place by spring clips 137 and 143. The spacing between ear 119 and flange 125 and between ear 121 and flange 127 is to allow space for connecting links 43 and 45 that constrain the foot platforms to move together. Bushings 151 and 153 are used with connecting links 43 and 45, and the link arrangements are shown in more detail in FIG. 6B.

The use of flanged bronze bushings in the hinge rod assembly adds bearing surface which provides lateral structural stability, resulting in prolonged life and smoother operation, and is an improvement over the prior art. The hinging of foot platform 31 to the pivot platform is accomplished in a similar manner and with similar parts as is shown in FIG. 4 for foot platform 29. Pivot platform 41 is mounted to carriage 11 by stove bolt and lock nut pairs 145 and 147, and this fastener set also secures a roller bracket 149 beneath the carriage that is further illustrated relative to roller assembly 61. The bushings may be of other bearing material in other embodiments, such as plastic bushings, for example.

Figures 6A, 6B:
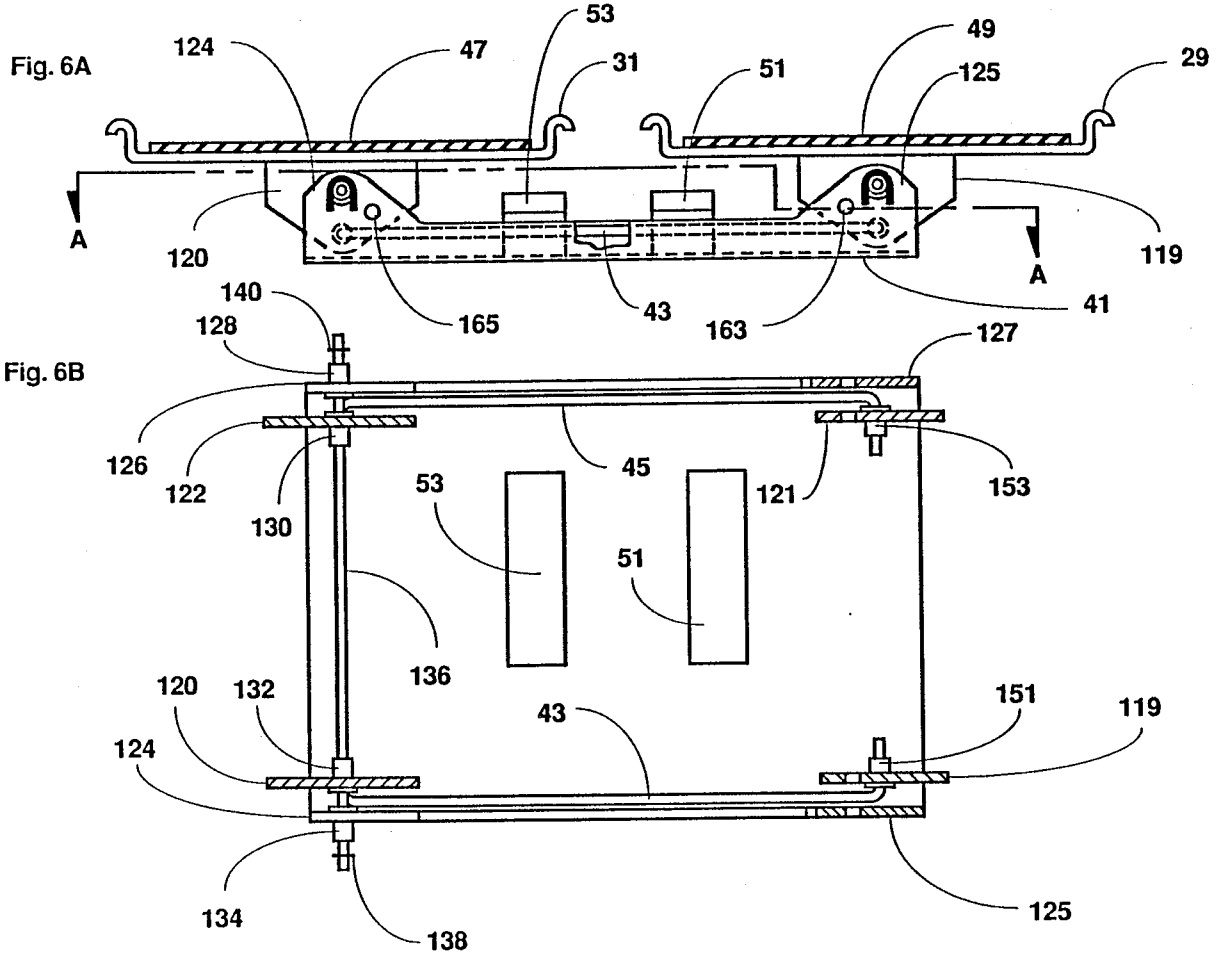
FIG. 6A is an elevation view of foot platforms on the wheeled carriage.
FIG. 6B is a plan view section of FIG. 6A taken along line A—A.

The foot platforms may rock to a limited degree about the hinged pivots illustrated in FIG. 4, but they may not rock independently of one another in the preferred embodiment. FIG. 6A is an elevation view of the two foot platforms showing the hinging and other connections in additional detail. FIG. 6B is a section view of this assembly along section line A—A of FIG. 6A, and in the direction of the arrows. The hinge arrangement based on hinge rod 136 for foot platform 31 is shown. Connecting link 43 is shown in FIG. 6A and both links 43 and 45 are shown in FIG. 6B. Link 43 connects ear 119 of foot platform 29 with ear 120 of foot platform 31 utilizing flanged bronze bushings 151 and 132. Link 45 connects ear 121 of foot platform 29 with ear 122 of foot platform 31 utilizing bushings 153 and 130. These connections constrain foot platforms 29 and 31 to rock together about their respective hinge rods so that they have at all times the same angular inclination to the horizontal. A stack 53 of resilient strips, previously illustrated in FIG. 1A, is positioned on pivot platform 41 so that rocking of the foot platforms in a clockwise direction is limited, but the limit is resilient rather than unyielding as would be the case if a metal stop were used. A similar stack 51 of resilient strips is positioned to similarly limit the rocking of the foot platforms in a counter-clockwise direction. The amount of movement afforded to the foot platforms and the force to resist the movement is adjustable by altering the stack height of the resilient strips and by changing the material. There are other means, such as coil and extension springs that may be used for this purpose, but the resilient strips are convenient and inexpensive. Springs and other devices may be used in other embodiments.

There are holes through the ears of the foot platforms and through the flanges of the pivot platform into which bushings may be inserted and a rod may be passed to lock the foot platforms so that they may not rotate. These holes show in FIG. 6A as hole 163 and 165. A matching hole in each of the ears and flanges behind hole 163 allows bushings and a rod to be inserted with platform 29 in a level aspect, and the arrangement prevents rotation of the platform around its hinge. A similar arrangement is associated with hole 165 for foot platform 31. With one or both locking rods in place, the exerciser may be operated with the foot platforms immobilized. The locking rods are assembled with spring clips similar to the assembly of the hinge rods so they may not come out in operation.

Carriage Restraint

As illustrated in FIG. 1A, carriage 11 rolls along rails 13 and 15 and is restrained in that movement both by flexible strap 23 and by adjustment assembly 57. Strap 23 is fastened underneath carriage 11 by clamp assembly 61, at one end of the rail set by clamp assembly 25 and at the opposite end of the rail set by clamp assembly 27. A user stands on the foot platforms and moves the carriage by shifting his or her weight from one side to the other in the actions associated with parallel skiing. To help in maintaining balance and to further simulate the actions of skiing, hand poles may be used that are similar to ski poles, but somewhat longer and tipped with a resilient material so they may be used indoors without damage to flooring or other materials that might be in the immediate area where an exerciser is used.

As a user urges the carriage to one side, the portion of strap 23 on the opposite side, between clamp assembly 61 under the carriage and the end clamp assembly, either 25 or 27, stretches and applies a force to the carriage opposite the force applied by the user, and tending to return the carriage toward the center. The user oscillates the carriage thusly back-and-forth on the rails simulating parallel skiing. As the user leans and shifts, the foot platforms tilt, simulating the edging effect used in skiing. The relative belt tensions control the effort required and the degree of difficulty, so a user may experience the physical demands just as they would be experienced on a ski slope.

Figure 7A:
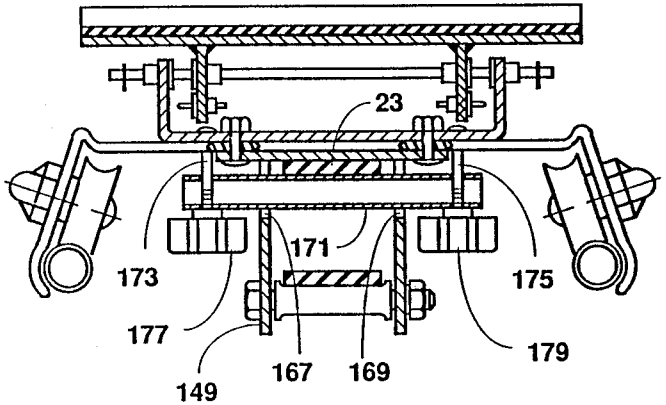
FIG. 7A is a section through the carriage showing the strap clamp arrangement for a strap of the exerciser.
Figure 7B:
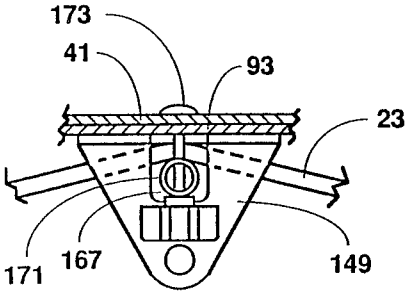
FIG. 7B is a side view of the clamp of the arrangement of FIG. 7A.

FIG. 7A illustrates clamp assembly 61 under the carriage, which is associated with roller bracket 149. FIG. 7B is a side view of the pivot bracket and clamp assembly. Roller bracket 149, which is bolted through carriage body 93 and pivot platform 41, has openings 167 and 169 through which a clamp bar 171 extends. Strap 23 passes between the clamp bar and the base of the roller bracket, and the clamp bar has two holes through which stove bolts 173 and 175 pass. The stove bolts extend through holes in the carriage with the heads on the upper end, and two plastic knobs 177 and 179 thread onto the stove bolts just below the clamp bar. The plastic knobs are commercially available hardware items with threaded metal inserts. By rotating the knobs, pressure is applied to the clamp bar, hence to the flexible strap, firmly clamping the strap between the bar and the bracket base.

Figure 8A:
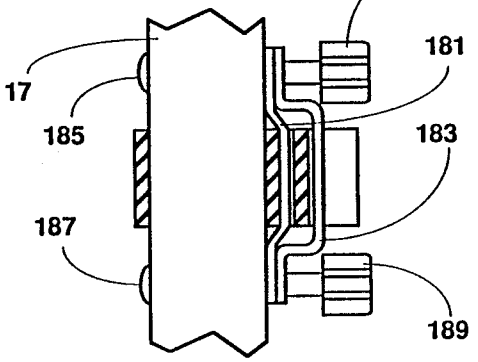
FIG. 8A is a plan view of the clamping arrangement for a strap at one end of the exerciser according to a preferred embodiment.
Figure 8B:
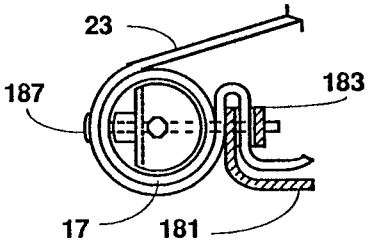
FIG. 8B is a side view in section of the clamp arrangement illustrated by FIG. 8A.

FIG. 8A and FIG. 8B show clamp assembly 25 associated with end member 17, where strap 23 is clamped at one end of the rail set. As may best be seen in FIG. 8B, strap 23 passes over and around end member 17, then up through an opening between the end member and a clamp strip 181. As may best be seen in FIG. 8A, both clamp strip 181 and a guide strip 183 are held proximate to end member 17 by two stove bolts 185 and 187, each bolt passing through end member 17 and both clamp strip 181 and guide strip 183. Two plastic knobs, 189 and 191, similar to knobs 177 and 179, are threaded onto the ends of the stove bolts, and by being rotated cause strap 23 to be clamped between clamp strip 181 and the cylinder of end member 17. The purpose of guide strip 183 is to neatly retain the end of strap 23 after it has been clamped.

The plastic knobs are not shown in section view FIG. 8B so the nature of the other components may be more clearly illustrated. The view of FIG. 8B is with the end cap removed, and rail end bracket 65 may be seen in position within end member 17. Bolts 185 and 187 pass through holes 66 and 68 in bracket 65 (see FIG. 2B). Clamp assembly 27 at the opposite end of the rail set, associated with end member 19, is similar to clamp assembly 25 illustrated above. The opposite end of flexible strap 23 is secured to end member 19 by clamp assembly 27.

Adjustment Assembly

Figure 9:
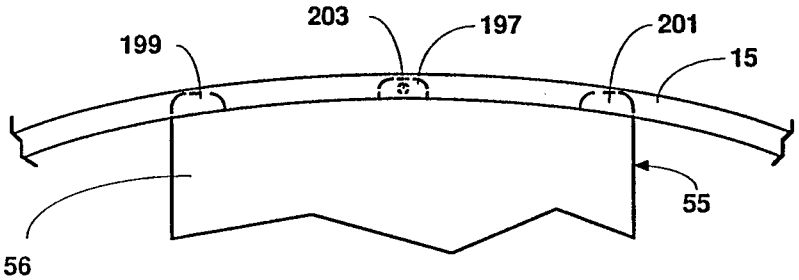
FIG. 9 is a side elevation showing one rail according to the invention and how a center support member fastens to the rail.

Center support 55 is a U-shaped member fastened below the rail set and to each rail. FIG. 9 shows a central portion of rail 15 from a side view and an upper portion of one vertical leg 56 of support member 55. Vertical leg 56 of member 55 has three ears 197, 199 and 201. Ears 199 and 201 are at each end of the vertical leg, and fit into slots on the underside of rail 15. Central ear 197 fits also into a slot on the underside of rail 15, and has also a hole 203 of about 0.6 cm. diameter. A similar vertical leg with similar ears fits into slots in rail 13. FIG. 4 shows self tapping screws 193 and 195 that pass through holes in rails 13 and 15 to engage the holes in the central ears of the sides of support member 55.

Figure 10:
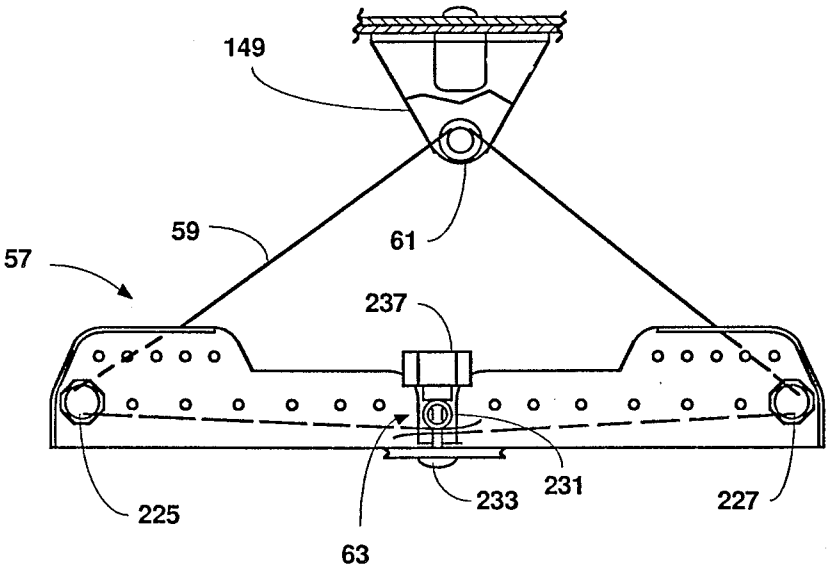
FIG. 10 is a side elevation view illustrating an adjustment assembly according to the invention.
Figure 11B:
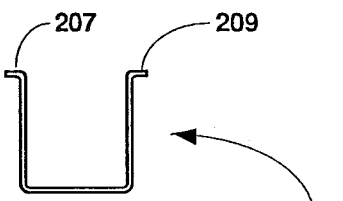
FIG. 11B is an end view of the frame element of FIG. 11A.
Figure 11A:
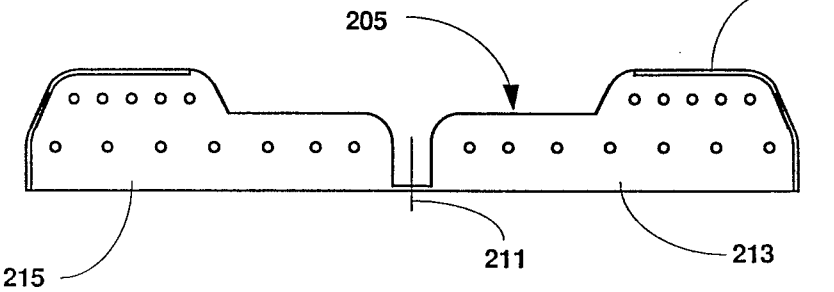
FIG. 11A is a side view of a frame element of the adjustment assembly.

Support member 55, as seen in FIG. 4, spaces and supports the rail set, and also supports adjustment assembly 57 and clamp assembly 63, seen in end view. FIG. 10 is a side elevation view of the adjustment and clamp assembly from the vantage of line B—B of FIG. 4. FIG. 11A is a side view of a U-shaped member 205 that is the principal frame of the adjustment assembly. Frame 205 is fastened in assembly to support member 55 by rivets (not shown). Riveting allows that each of the pieces be polished and chrome plated separately and that the assembly be made without harming the desired finish. Other methods of fastening may also be used. FIG. 11B is an end view of frame 205. Lips 207 and 209 which are welded to upper edges of side legs of frame 205 are to present a blunt edge for safety purposes. Similar lips are added to the opposite end of the frame member. In the preferred embodiment, these lips are welded, but the sharp edges may be occluded as well in other ways, such as with plastic edging strips.

Frame 205 is symmetrical about a centerline 211 and there are four upright portions. Portions 213 and 215 of FIG. 11A are mirror image portions, and there are similar portions forming the other side of the frame. There are two horizontal rows of holes in the four upright portions. In portions 213 and 215 the holes are round and each about 0.6 cm diameter. In the similar portions forming the uprights on the other side of the frame the holes are square to fit the under-head of standard stove bolts. The lower row in each portion is an array of seven holes in the preferred embodiment, about 2.9 cm. above the base and spaced about 3.5 cm. apart. The upper row of five holes is about 6 cm. above the base and the holes are spaced about 2 cm. apart. These patterns are mirrored in the other upright portions of the frame member.

Figure 12:
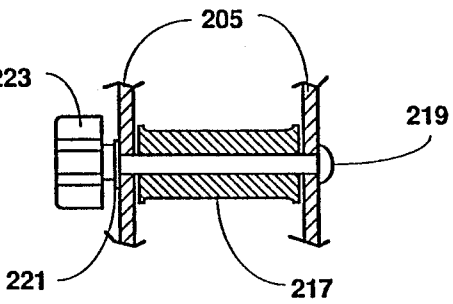
FIG. 12 illustrates a roller assembly that is used with a flexible strap in the exerciser.

Using any hole set consisting of a round hole in one upright portion and the matching square hole in another, across the width of frame 206, a roller assembly may be assembled. FIG. 12 shows such an assembly. A roller 217 of UHMW material and with a central hole, is suspended between the vertical legs of frame 205 by a stove bolt 219. The under-head of the stove bolt fits into the square hole on one side, and the threaded portion extends through the round hole on the other. A spring washer 221 is used with a plastic knob 223, which is similar to plastic knobs 189 and 191, to secure the assembly. The fit between the central hole of the roller and the shaft of the stove bolt is such that the roller may freely rotate. The use of the spring washer allows a user to snug the plastic knob without applying so much pressure that the sides of the frame will flex and bind the assembly.

In FIG. 10 a roller assembly 225, similar to the assembly of FIG. 12 is assembled to the outermost position of the lower line of seven hole sets at one end of frame member 205. Another roller assembly 227 is assembled to the outermost hole set in the lower row at the opposite end of the frame member. Roller assembly 61 is similar to the other roller assemblies illustrated, and is assembled across the sides of roller bracket 149 which is fastened underneath carriage 11. Roller assembly 61 differs in that a lock nut is used in place of a plastic knob because this assembly is not normally moved for adjustment of forces for the exerciser. Lock nut 229 is shown relative to roller assembly 61 in end view in FIG. 4.

Figure 13:
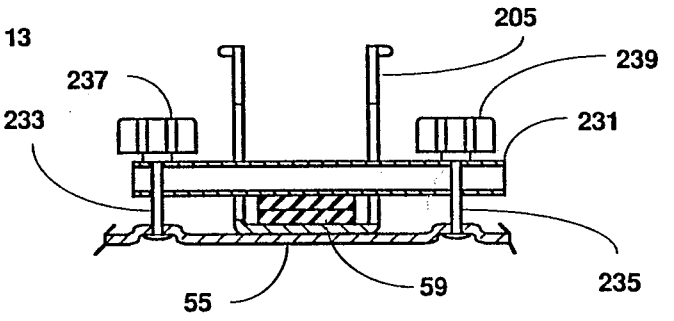
FIG. 13 is a section view illustrating a strap clamp as used according to the preferred embodiment with the adjustment assembly.

As further illustrated in FIG. 10 and FIG. 13, as the center of the adjustment assembly there is a clamp assembly 63 for clamping flexible strap 59 which is similar to the clamp used at the center of roller bracket 149 to clamp flexible strap 23. A clamp rod 231 passes through the center opening of frame 205, and has two holes through which stove bolts 233 and 235 pass. The stove bolts protrude through holes in support member 55 from below. Plastic knobs 237 and 239 are used with the stove bolts to apply downward pressure to clamp ends of flexible strap 59 between the clamp rod and the base of frame member 205.

Flexible strap 59 is represented in FIG. 10 by a solid and dotted line passing over roller assembly 61 under the carriage, around roller assemblies 225 and 227 near the ends of adjustment assembly 57, with the ends clamped at the center with clamp assembly 63. This is a standard position for the assembly of the exerciser according to the preferred embodiment. Once the two flexible straps 23 and 59 of the exerciser are secured; strap 23 by clamp assemblies 25 and 27 at the ends and again underneath the carriage; and strap 59 by clamp assembly 63 at the center of the adjustment assembly; the clamps need not be loosened again to make force adjustments. This is a unique improvement over the prior art.

Figure 14:
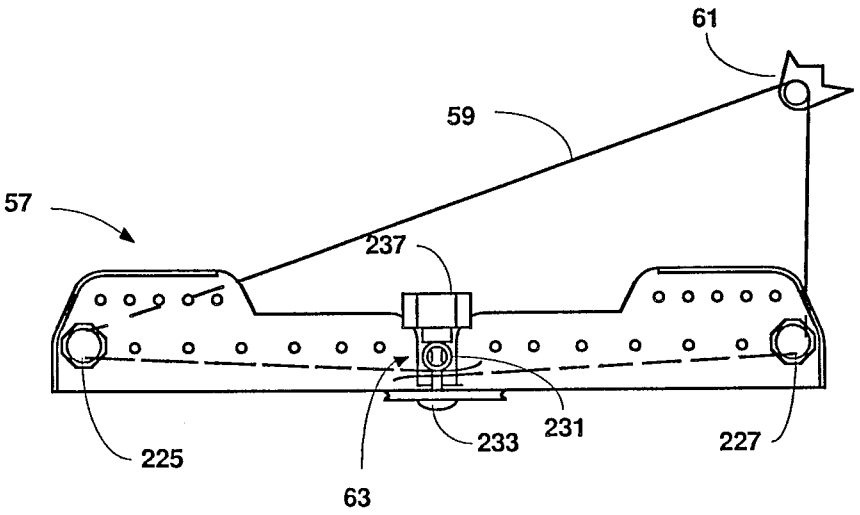
FIG. 14 shows the adjustment assembly set for an average user with the carriage urged to one side.

FIG. 14 shows a situation in which a user has shifted the carriage to one side, so that roller assembly 61 is about overhead one end of adjustment assembly 57. A unique and valuable aspect of the invention is illustrated. The force applied by the stretching of flexible strap 59 is a result of the stretch of the entire length of the strap over the three roller assemblies. Force is thus applied more gradually as the carriage moves rather than suddenly as is the case with the safety strap in the prior art. Moreover, the sharing of the deformation over a greater length of strap with no localized areas of excessive deformation, lowers the average stress level and alleviates fatigue effects, so that the straps may be expected to perform much longer in service.

Figure 15:
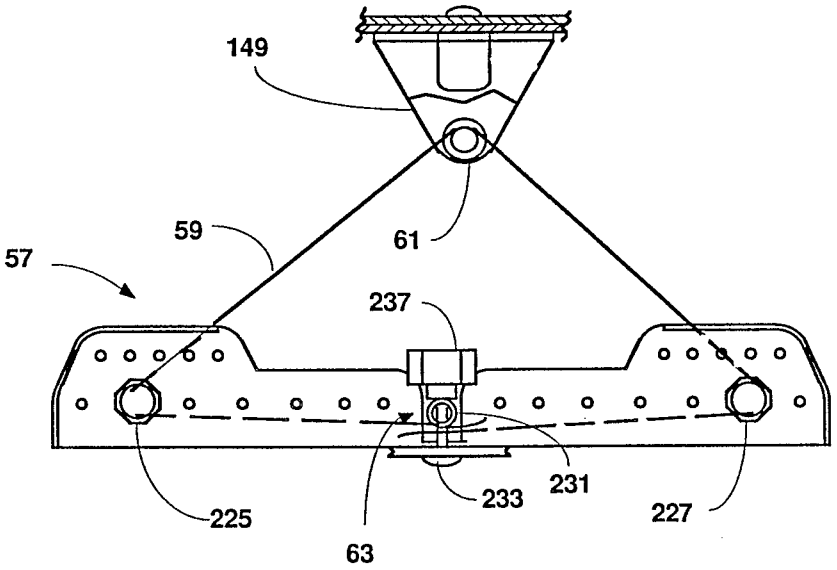
FIG. 15 shows the adjustment assembly set at a less agressive setting than the setting for the average user.

From the assembly of FIG. 10, which is a standard starting point, if it is desired that a lower restoring force be applied to return the carriage, as would be the case for a smaller than average user, such as a child, roller assemblies 225 and 227 may be each moved to a position toward the center of the adjustment assembly. By successively moving the roller assemblies one hole spacing toward the center, on each side, the beginning restoring force and the range of force may be reduced in seven steps, corresponding to the seven hole positions in the set. FIG. 15 shows roller assemblies 225 and 227 assemble in the No. 6 position, where the outermost position is considered the No. 7 position.

Figure 16:
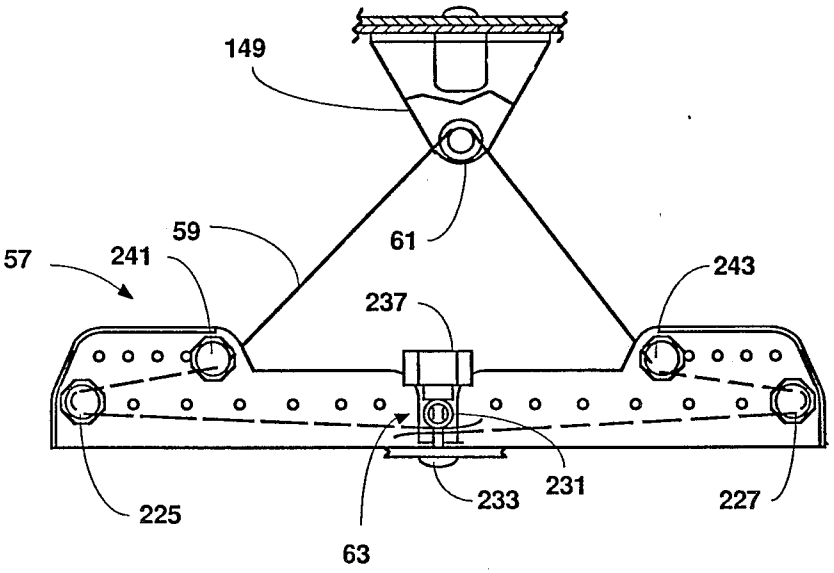
FIG. 16 shows the adjustment assembly at the most agressive setting.

From the assembly of FIG. 10, if it desired that the restoring force start at a greater force than that for the standard position, which would be the case, for instance, for a larger than normal user, or for a competitor or other agressive skier, who would want a demanding exercise, additional roller assemblies may be added to the top row to increase the initial belt tension, which will also increase the range of force over which the exercise will operate. FIG. 16 shows two additional roller assemblies 241 and 243 assembled to the innermost hole positions in the top row of holes in the frame of the adjustment assembly. This is the most agressive adjustment position of the roller assemblies, and will provide a challenge to the skill and endurance of the most agressive skier.

Figure 17:
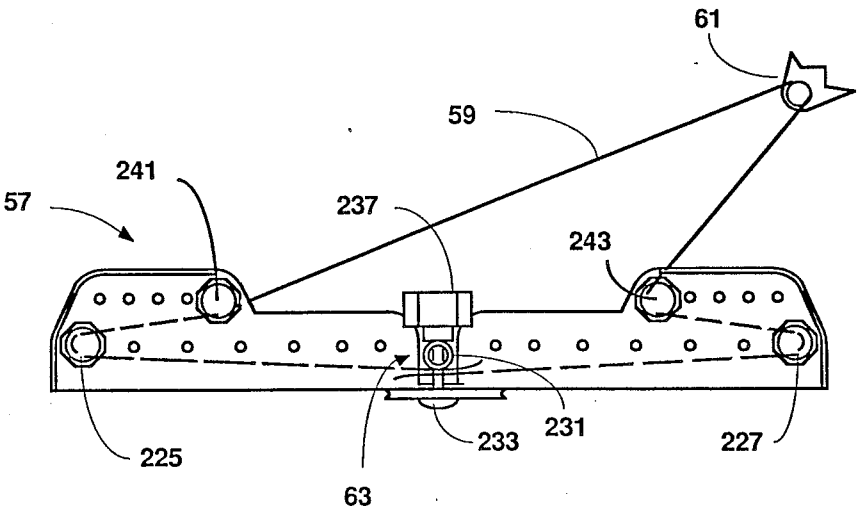
FIG. 17 shows the adjustment assembly at the most agressive setting and with the carriage urged to one side.

FIG. 17 shows the adjustment of FIG. 16 with the carriage deflected to one side about the same amount as was the case in FIG. 14, and it is seen that the unique pattern of hole placement for the adjustment assembly provides not only a higher starting force, but also will provide a greater range of force and an increase in the rate at which force applies, due to the folding of strap 59 around the roller assemblies. As roller assembly 61 passes above assembly 243, the force applied to the carriage will increase dramatically, and the same will be true for movement in the opposite direction as roller assembly 61 passes over assembly 241 and continues. Still, the stretching of flexible strap 59 always is over the full length of the strap, due to the rollers, which do not tend to fray the strap.

It will be apparent to those skilled in the art that there are many changes that may be made in detail in the invention without departing from the spirit and scope of the invention. One may, for example, operate the exercise with the foot platforms removed, therefore without the feature simulating edging technique. The amount that the foot platforms are allowed to tilt may be changed by changing the resilient stops placed beneath the foot platforms. It is quite possible that foot platforms may be installed such that the platforms may swivel instead of tilt, or swivel and tilt at the same time. The material of one or both flexible straps may be changed. The tension of the straps may be adjusted by adjusting clamps and rollers. The layout of holes in a frame for moving rollers from one position to another to adjust the response of the exercise to a user may be altered in a wide variety of ways without departing from the spirit and scope of the invention. Similarly, instead of two rows of holes in the adjusting frame for moving rollers, there may be only one row of holes. The following claims are meant to cover all such equivalents of the previously described invention.

What is claimed is:

1. A device for exercising comprising:

a pair of rails positioned in a spaced apart parallel relationship;

brace means for holding said rails in said spaced apart relationship;

platform means for providing a stable riding area for riding along said rails;

first resilient means for providing a first restoring force on said platform means toward the middle of said rails;

second resilient means for providing a second restoring force on said platform means toward the middle of said rails;

adjustment means for adjusting the magnitude of said second restoring force, said adjustment means contacting said second resilient means at at least three points, with a first one of said three points located in a vertical plane on one side of the middle of said rails, with a second one of said three points located in a vertical plane on the other side of the middle of said rails, and with a third one of said three points associated with said platform means and moving therewith.

2. A device as in claim 1 wherein said adjustment means further comprises movement means for moving said first and second points in at least one of a horizontal direction and a vertical direction, thereby changing the magnitude of the restoring force caused by said second resilient means.

3. A device as in claim 2 wherein said adjustment means comprises roller means located at said first and second points, for providing a rolling surface to said second resilient means at each of said first and second points.

4. A device as in claim 3 wherein said adjustment means further comprises second roller means located at said third point and attached to said platform means, for providing a rolling surface to said second resilient means.

5. A device as in claim 4 wherein said adjustment means further comprises attachment means for attaching said second resilient means to said brace means.

6. A device as in claim 5 wherein said brace means comprises a U-shaped support member located at the middle of said rails, the bottom side of said member serving to exert a supporting force against a surface on which the exercise device is used, such as a floor, with each upper side of said U-shape being attached to one of said rails.

7. A device as in claim 6 wherein said platform means comprises a bottom portion having a plurality of wheels for riding along said rails.

8. A device as in claim 7 wherein said platform means comprises bracket means located under the bottom portion of said platform means for holding said second roller means.

9. A device as in claim 8 wherein said adjustment means further comprises a frame portion having two spaced apart parallel walls attached to said brace means, each wall having a plurality of holes therethrough, with the holes on opposite walls being in alignment with each other, said holes being located on both sides of the middle of said rails.

10. A device as in claim 9 wherein said adjustment means further comprises a first adjustment roller on a pin that extends through a pair of aligned holes in said frame portion on one side of the middle of said rails to define said first contact point, and a second adjustment roller on a pin that extends through a second pair of aligned holes in said frame portion on the other side of the middle of said rails to define said second contact point.

11. A device as in claim 10 wherein said holes in said frame portion are located in two horizontal rows, with one of the rows above the other.

12. A device as in claim 11 wherein said adjustment means further comprises a third adjustment roller on a pin that extends through a pair of aligned holes on a different horizontal row than said first adjustment roller, said third adjustment roller located to engage said second resilient means.

13. A device as in claim 12 wherein said adjustment means further comprises a fourth adjustment roller on a pin that extends through a pair of aligned holes on a different horizontal row than said first adjustment roller, said fourth adjustment roller located to engage said second resilient means.

* * * * *